US008489392B2

(12) United States Patent
Nurminen et al.

(10) Patent No.: US 8,489,392 B2
(45) Date of Patent: Jul. 16, 2013

(54) SYSTEM AND METHOD FOR MODELING SPEECH SPECTRA

(75) Inventors: Jani Nurminen, Lempäälä (FI); Sakari Himanen, Tampere (FI)

(73) Assignee: Nokia Corporation, Espoo (FI)

( * ) Notice: Subject to any disclaimer, the term of this patent is extended or adjusted under 35 U.S.C. 154(b) by 767 days.

(21) Appl. No.: 11/855,108

(22) Filed: Sep. 13, 2007

(65) Prior Publication Data

US 2008/0109218 A1 May 8, 2008

Related U.S. Application Data

(60) Provisional application No. 60/857,006, filed on Nov. 6, 2006.

(51) Int. Cl.
*G10L 11/06* (2006.01)

(52) U.S. Cl.
USPC ..... 704/208; 704/220; 704/221; 704/205

(58) Field of Classification Search
USPC ..... 704/208, 220, 221, 205
See application file for complete search history.

(56) References Cited

U.S. PATENT DOCUMENTS

| | | | | |
|---|---|---|---|---|
| 6,233,551 | B1 | 5/2001 | Cho et al. | |
| 6,475,245 | B2 * | 11/2002 | Gersho et al. | 704/208 |
| 2003/0097260 | A1 * | 5/2003 | Griffin et al. | 704/230 |
| 2004/0153317 | A1 | 8/2004 | Chamberlain | |
| 2005/0075869 | A1 * | 4/2005 | Gersho et al. | 704/223 |

FOREIGN PATENT DOCUMENTS

| | | |
|---|---|---|
| EP | 1089255 | 4/2001 |
| EP | 1420390 | 5/2004 |
| EP | 1420390 A1 | 5/2004 |
| EP | 1577881 | 9/2005 |
| WO | WO 01/22403 A1 | 3/2001 |

OTHER PUBLICATIONS

International Search report for PCT Patent Application No. PCT/IB2007/053894.
Office Action for Korean Patent Application No. 2009-7011602, dated Nov. 12, 2010.
English translation of Office Action for Korean Patent Application No. 2009-7011602, dated Nov. 12, 2010.
Chinese Patent Application No. 2007800041119.1, dated May 11, 2011.
English translation of Office Action for Chinese Patent Application No. 2007800041119.1, dated May 11, 2011.
Second Office Action from Chinese Patent Application No. 200780041119.1, dated Feb. 29, 2012.
Extended Search Report for European Application No. 07 826 537.8 dated Nov. 14, 2012.
Office Action from Chinese Patent Application No. 200780041119.1, dated Sep. 20, 2012.

* cited by examiner

*Primary Examiner* — Qi Han
(74) *Attorney, Agent, or Firm* — Alston & Bird LLP

(57) ABSTRACT

A system and method for modeling speech in such a way that both voiced and unvoiced contributions can co-exist at certain frequencies. In various embodiments, three spectral bands (or bands of up to three different types) are used. In one embodiment, the lowest band or group of bands is completely voiced, the middle band or group of bands contains both voiced and unvoiced contributions, and the highest band or group of bands is completely unvoiced. The embodiments of the present invention may be used for speech coding and other speech processing applications.

33 Claims, 3 Drawing Sheets

SYSTEM AND METHOD FOR MODELING SPEECH SPECTRA

CROSS-REFERENCE TO RELATED APPLICATIONS

The present application claims priority to U.S. Provisional Patent Application No. 60/857,006, filed Nov. 6, 2006.

FIELD OF THE INVENTION

The present invention relates generally to speech processing. More particularly, the present invention relates to speech processing applications such as speech coding, voice conversion and text-to-speech synthesis.

BACKGROUND OF THE INVENTION

This section is intended to provide a background or context to the invention that is recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Many speech models rely on a linear prediction (LP)-based approach, in which the vocal tract is modeled using the LP coefficients. The excitation signal, i.e. the LP residual, is then modeled using further techniques. Several conventional techniques are as follows. First, the excitation can be modeled either as periodic pulses (during voiced speech) or as noise (during unvoiced speech). However, the achievable quality is limited because of the hard voiced/unvoiced decision. Second, the excitation can be modeled using an excitation spectrum that is considered to be voiced below a time-variant cut-off frequency and unvoiced above the frequency. This split-band approach can perform satisfactorily on many portions of speech signals, but problems can still arise, especially with the spectra of mixed sounds and noisy speech. Third, a multiband excitation (MBE) model can be used. In this model, the spectrum can comprise several voiced and unvoiced bands (up to the number of harmonics). A separate voiced/unvoiced decision is performed for every band. The performance of the MBE model, although reasonably acceptable in some situations, still possesses limited quality with regard to the hard voiced/unvoiced decisions for the bands. Fourth, in waveform interpolation (WI) speech coding, the excitation is modeled as a slowly evolving waveform (SEW) and a rapidly evolving waveform (REW). The SEW corresponds to the voiced contribution, and the REW represents the unvoiced contribution. Unfortunately, this model suffers from large complexity and from the fact that it is not always possible to obtain perfect separation into a SEW and a REW.

It would therefore be desirable to provide an improved system and method for modeling speech spectra that addresses many of the above-identified issues.

SUMMARY OF THE INVENTION

Various embodiments of the present invention provide a system and method for modeling speech in such a way that both voiced and unvoiced contributions can co-exist at certain frequencies. To keep the complexity at a moderate level, three sets of spectral bands (or bands of up to three different types) are used. In one particular implementation, the lowest band or group of bands is completely voiced, the middle band or group of bands contains both voiced and unvoiced contributions, and the highest band or group of bands is completely unvoiced. This implementation provides for high modeling accuracy in places where it is needed, but simpler cases are also supported with a low computational load. The embodiments of the present invention may be used for speech coding and other speech processing applications, such as text-to-speech synthesis and voice conversion.

The various embodiments of the present invention provide for a high degree of accuracy in speech modeling, particularly in the case of weakly voiced speech, while at the same time enduring only a moderate computational load. The various embodiments also provide for an improved trade-off between accuracy and complexity relative to conventional arrangements.

These and other advantages and features of the invention, together with the organization and manner of operation thereof, will become apparent from the following detailed description when taken in conjunction with the accompanying drawings, wherein like elements have like numerals throughout the several drawings described below.

DETAILED DESCRIPTION OF VARIOUS EMBODIMENTS

Various embodiments of the present invention provide a system and method for modeling speech in such a way that both voiced and unvoiced contributions can co-exist at certain frequencies. To keep the complexity at a moderate level, three sets of spectral bands (or bands of up to three different types) are used. In one particular implementation, the lowest band or group of bands is completely voiced, the middle band or group of bands contains both voiced and unvoiced contributions, and the highest band or group of bands is completely unvoiced. This implementation provides for high modeling accuracy in places where it is needed, but simpler cases are also supported with a low computational load. The embodiments of the present invention may be used for speech coding and other speech processing applications, such as text-to-speech synthesis and voice conversion.

The various embodiments of the present invention provide for a high degree of accuracy in speech modeling, particularly in the case of weakly voiced speech, while at the same time enduring only a moderate computational load. The various embodiments also provide for an improved trade-off between accuracy and complexity relative to conventional arrangements.

Figure 1:
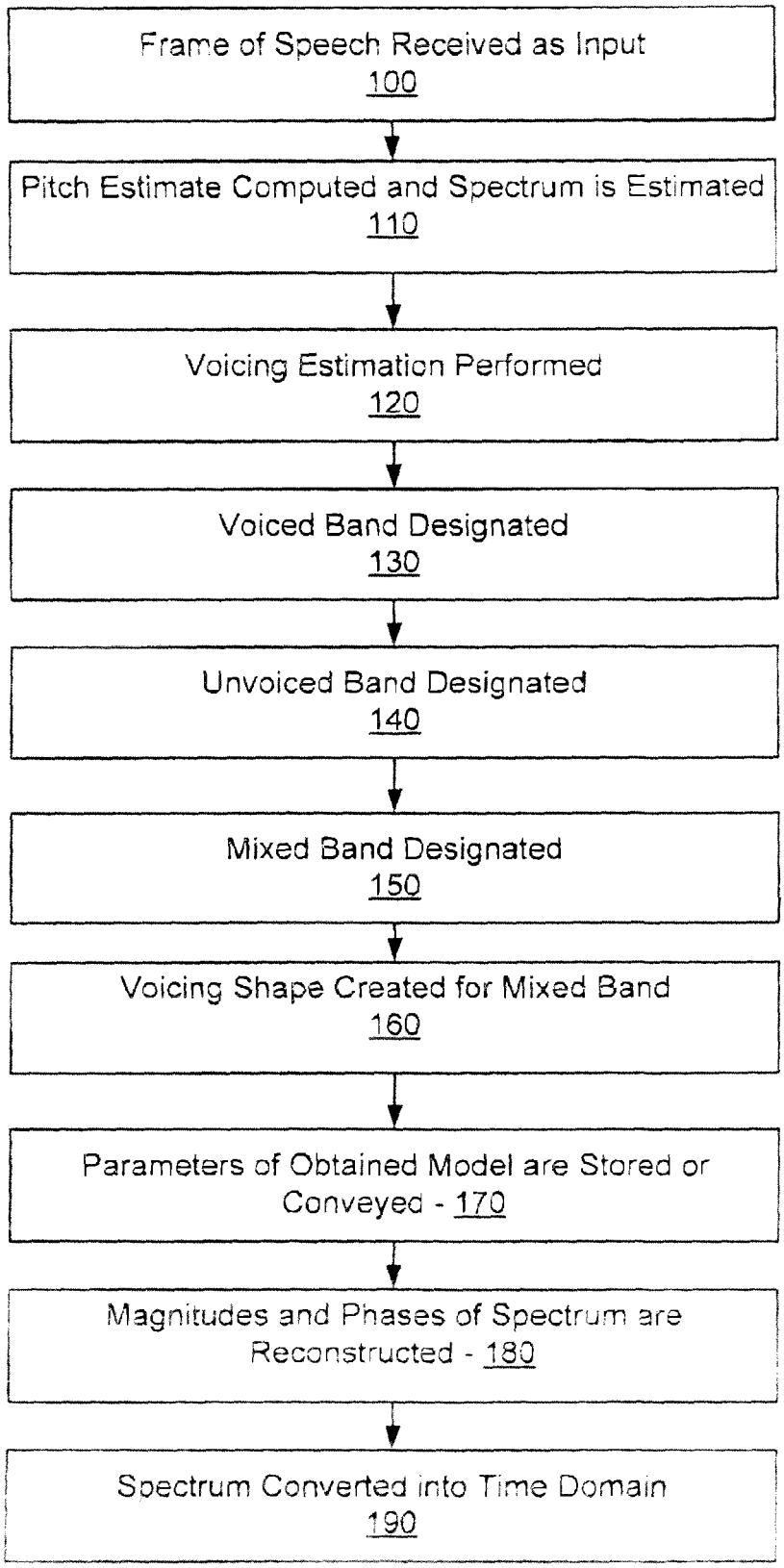
FIG. 1 is a flow chart showing how various embodiments may be implemented.

FIG. 1 is a flow chart showing the implementation of one particular embodiment of the present invention. At 100 in FIG. 1, a frame of speech (e.g., a 20 millisecond frame) is received as input. At 110, a pitch estimate for the current frame is computed, and an estimation of the spectrum (or the excitation spectrum) sampled at the pitch frequency and its harmonics is obtained. It should be noted, however, that the spectrum can be sampled in a way other than at pitch harmonics. At 120, voicing estimation is performed at each harmonic frequency. Instead of obtaining a hard decision between voiced (denoted, e.g., using the value 1.0) and unvoiced (denoted, e.g., using the value 0.0), a "voicing likelihood" is obtained (e.g., between the range from 0.0 to 1.0). Because voicing in nature is not a discrete value, a variety of known estimation techniques can be used for this process.

At 130, the voiced band is designated. This can be accomplished by start from the low frequency end of the spectrum, and going through the voicing values for the harmonic frequencies until the voicing likelihood drops below a pre-specified threshold (e.g., 0.9). The width of the voiced band can even be 0, or the voiced band can cover the whole spectrum if necessary. At 140, the unvoiced band is designated. This can be accomplished by starting from the high frequency end of the spectrum, and going through the voicing values for the harmonic frequencies until the voicing likelihood is above a pre-specified threshold (e.g., 0.1). Like for the voiced band, the width of the unvoiced band can be 0, or the band can also cover the whole spectrum if necessary. It should be noted that, for both the voiced band and the unvoiced band, a variety of scales and/or ranges can be used, and individual "voiced values" and "unvoiced values" could be located in many portions of the spectrum as necessary or desired. At 150, the spectrum area between the voiced band and the unvoiced band is designated as a mixed band. As is the case for the voiced band and the unvoiced band, the width of the mixed band can range from 0 to covering the entire spectrum. The mixed band may also be defined in other ways as necessary or desired.

At 160, a "voicing shape" is created for the mixed band. One option for performing this action involves using the voicing likelihoods as such. For example, if the bins used in voicing estimation are wider than one harmonic interval, then the shape can be refined using interpolation either at this point or at 180 as explained below. The voicing shape can be further processed or simplified in the case of speech coding to allow for efficient compression of the information. In a simple case, a linear model within the band can be used.

At 170, the parameters of the obtained model (in the case of speech coding) are stored or, e.g., in the case of voice conversion, are conveyed for further processing or for speech synthesis. At 180, the magnitudes and phases of the spectrum based on the model parameters are reconstructed. In the voiced band, the phase can be assumed to evolve linearly. In the unvoiced band, the phase can be randomized. In the mixed band, the two contributions can be either combined to achieve the combined magnitude and phase values or represented using two separate values (depending on the synthesis technique). At 190, the spectrum is converted into a time domain. This conversion can occur using, for example, a discrete Fourier transform or sinusoidal oscillators. The remaining portion of the speech modelling can be accomplished by performing linear prediction synthesis filtering to convert the synthesized excitation into speech, or by using other processes that are conventionally known.

As discussed herein, items 110 through 170 relate specifically to the speech analysis or encoding, while items 180 through 190 relate specifically to the speech synthesis or decoding.

In addition to the process depicted in FIG. 1 and as discussed above, a number of variations to the encoding and decoding process are also possible. For example, the processing framework and the parameter estimation algorithms can be different than those discussed above. Additionally, different voicing detection algorithms can be used, and the width of each frequency bin can be varied. Furthermore, the modeling can use only the mixed band, or it is possible to use many bands representing the three different band types instead of using one band of each type. Still further, the determination of the voicing shape can be performed in other ways than that discussed above, and the details of the synthesis approach can be varied.

The various embodiments of the present invention provide for a high degree of accuracy in speech modeling, particularly in the case of weakly voiced speech, while at the same time enduring only a moderate computational load. The various embodiments also provide for an improved trade-off between accuracy and complexity relative to conventional arrangements.

Devices implementing the various embodiments of the present invention may communicate using various transmission technologies including, but not limited to, Code Division Multiple Access (CDMA), Global System for Mobile Communications (GSM), Universal Mobile Telecommunications System (UMTS), Time Division Multiple Access (TDMA), Frequency Division Multiple Access (FDMA), Transmission Control Protocol/Internet Protocol (TCP/IP), Short Messaging Service (SMS), Multimedia Messaging Service (MMS), e-mail, Instant Messaging Service (IMS), Bluetooth, IEEE 802.11, etc. A communication device may communicate using various media including, but not limited to, radio, infrared, laser, cable connection, and the like.

Figure 2:
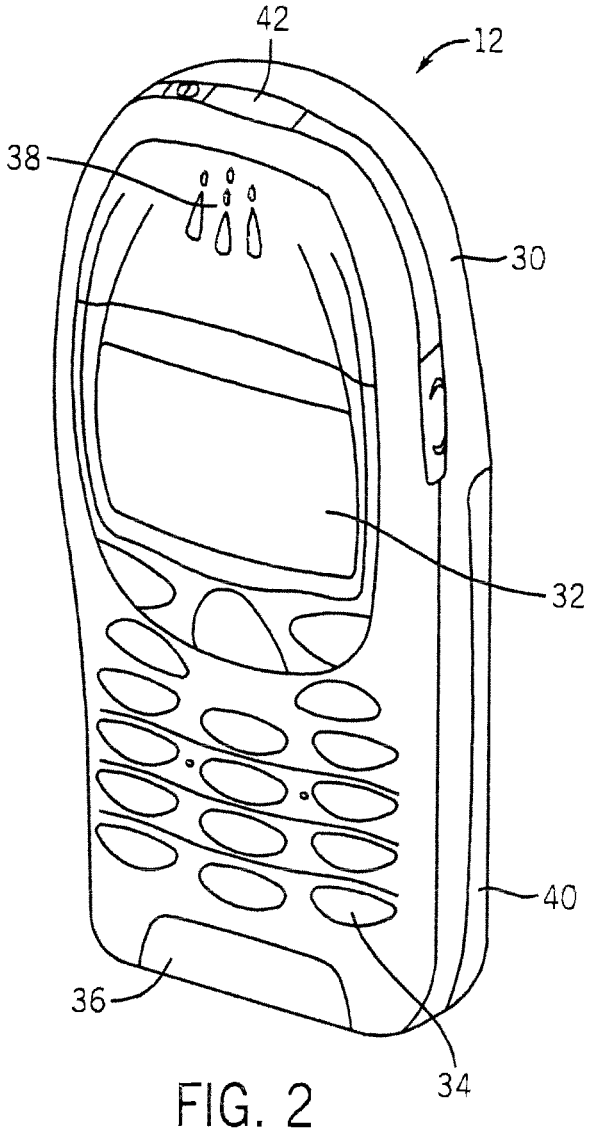
FIG. 2 is a perspective view of a mobile telephone that can be used in the implementation of the present invention.
Figure 3:
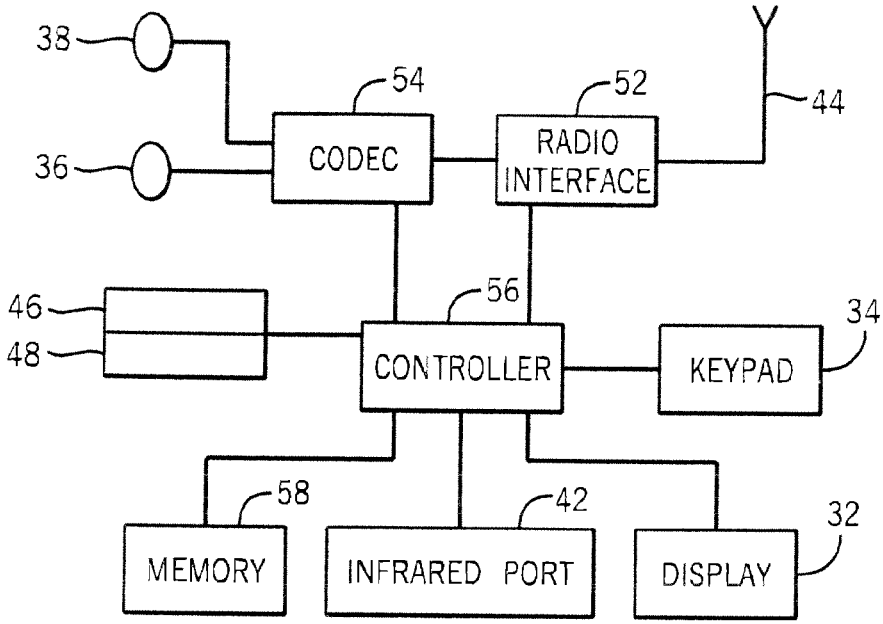
FIG. 3 is a schematic representation of the telephone circuitry of the mobile telephone of FIG. 2.

FIGS. 2 and 3 show one representative mobile telephone 12 within which the present invention may be implemented. It should be understood, however, that the present invention is not intended to be limited to one particular type of mobile telephone 12 or other electronic device. The mobile telephone 12 of FIGS. 2 and 3 includes a housing 30, a display 32 in the form of a liquid crystal display, a keypad 34, a microphone 36, an ear-piece 38, a battery 40, an infrared port 42, an antenna 44, a smart card 46 in the form of a UICC according to one embodiment of the invention, a card reader 48, radio interface circuitry 52, codec circuitry 54, a controller 56 and a memory 58. Individual circuits and elements are all of a type well known in the art, for example in the Nokia range of mobile telephones.

The present invention is described in the general context of method steps, which may be implemented in one embodiment by a program product including computer-executable instructions, such as program code, executed by computers in networked environments. Generally, program modules include routines, programs, objects, components, data structures, etc. that perform particular tasks or implement particular abstract data types. Computer-executable instructions, associated data structures, and program modules represent examples of program code for executing steps of the methods disclosed herein. The particular sequence of such executable instructions or associated data structures represents examples of corresponding acts for implementing the functions described in such steps.

Software and web implementations of the present invention could be accomplished with standard programming techniques with rule based logic and other logic to accomplish various actions. It should also be noted that the words "component" and "module," as used herein and in the claims, is intended to encompass implementations using one or more lines of software code, and/or hardware implementations, and/or equipment for receiving manual inputs.

The foregoing description of embodiments of the present invention have been presented for purposes of illustration and description. It is not intended to be exhaustive or to limit the present invention to the precise form disclosed, and modifications and variations are possible in light of the above teachings or may be acquired from practice of the present invention. The embodiments were chosen and described in order to explain the principles of the present invention and its practical application to enable one skilled in the art to utilize the present invention in various embodiments and with various modifications as are suited to the particular use contemplated.

What is claimed is:

1. A method, comprising:

obtaining an estimation of a frequency spectrum for a speech frame;

assigning a voicing likelihood value for a plurality of frequencies within the estimated frequency spectrum;

identifying at least one voiced band by determining a width within the frequency spectrum comprising a first subset of the plurality of frequencies within the estimated frequency spectrum with voicing likelihood values above a pre-specified threshold;

identifying at least one unvoiced band by determining a width within the frequency spectrum comprising a second subset of the plurality of frequencies within the estimated frequency spectrum with voicing likelihood values below a pre-specified threshold;

identifying at least one mixed band by determining a width within the frequency spectrum comprising a third subset of the plurality of frequencies between the voiced band and the unvoiced band;

creating a voicing shape for the at least one mixed band of frequencies; and at least one of storing or conveying to a remote device parameters of a model associated with the at least one voiced band, the at least one unvoiced band and the at least one mixed band, wherein the parameters of the model include parameters associated with the voicing shape.

2. The method of claim 1, wherein:

the at least one voiced band includes zero or more frequencies of the plurality of frequencies having voicing likelihood values within a first range of values;

the at least one unvoiced band includes zero or more frequencies of the plurality of frequencies having voicing likelihood values within a second range of values; and the at least one mixed band includes zero or more frequencies of the plurality of frequencies having voicing likelihood values between the at least one voiced band and the at least one unvoiced band.

3. The method of claim 1, wherein the estimation of the frequency spectrum for the speech frame is sampled at a determined pitch frequency and its harmonics.

4. The method of claim 1, further comprising further processing the parameters.

5. The method of claim 1, wherein the creation of the voicing shape is accomplished using voicing likelihood values in the at least one mixed band.

6. The method of claim 1, wherein the creation of the voicing shape includes interpolating values between voicing likelihood values in the at least one mixed band.

7. The method of claim 1, wherein at least one of the at least one voiced band, the at least one unvoiced band, and the at least one mixed band covers the entire spectrum of the plurality of frequencies.

8. The method of claim 1, wherein at least one of the at least one voiced band, the at least one unvoiced band, and the at least one mixed band covers no portion of the spectrum of the plurality of frequencies.

9. The method of claim 1, wherein the at least one voiced band, the at least one unvoiced band, and the at least one mixed band each comprise a single band.

10. A computer program product, embodied in a non-transitory computer-readable medium, for obtaining a model of a speech frame, comprising computer code for performing the actions of claim 1.

11. An apparatus, comprising:

means for reconstructing magnitude and phase values of a frequency spectrum based on parameters of a model associated with the frequency spectrum, the frequency spectrum having a plurality of frequencies, the frequency spectrum comprising at least one voiced band, at least one unvoiced band and at least one mixed band, wherein the voiced band is identified by determining a width within the frequency spectrum comprising a first subset of the plurality of frequencies within the estimated frequency spectrum with voicing likelihood values above a pre-specified threshold, the unvoiced band is identified by determining a width within the frequency spectrum comprising a second subset of the plurality of frequencies within the estimated frequency spectrum with voicing likelihood values below a pre-specified threshold, and the mixed band is identified by determining a width within the frequency spectrum comprising a third subset of the plurality of frequencies between the voiced hand and the unvoiced band, and wherein the parameters of the model include parameters associated with a voicing shape corresponding to the at least one mixed band; and means for converting the frequency spectrum into a time domain.

12. The apparatus of claim 11, wherein, for the reconstruction of the spectrum, the magnitude and phase value for the at least one mixed band comprise a combination of the respective magnitude and phase values for the voiced and unvoiced contributions.

13. An apparatus, comprising:

a processor; and a memory unit communicatively connected to the processor and including:

computer code for obtaining an estimation of a frequency spectrum for a speech frame;

computer code for assigning a voicing likelihood value for each frequency of a plurality of frequencies within the estimated frequency spectrum;

computer code for identifying at least one voiced band by determining a width within the frequency spectrum comprising a first subset of the plurality of frequencies within the estimated frequency spectrum with voicing likelihood values above a pre-specified threshold;

computer code for identifying at least one unvoiced band by determining a width within the frequency spectrum comprising a second subset of the plurality of frequencies within the estimated frequency spectrum with voicing likelihood values below a pre-specified threshold;

computer code for identifying at least one mixed band by determining a width, within the frequency spectrum comprising a third subset of the plurality of frequencies between the voiced band and the unvoiced band; and computer code for creating a voicing shape for the at least one mixed band of frequencies.

14. The apparatus of claim 13, wherein the at least one voiced band includes zero or more frequencies of the plurality of frequencies having voicing likelihood values within a first range of values;

the at least one unvoiced band includes zero or more frequencies of the plurality of frequencies having voicing likelihood values within a second range of values; and the at least one mixed band includes zero or more frequencies of the plurality of frequencies having voicing likelihood values between the at least one voiced band and the at least one unvoiced band.

15. The apparatus of claim 13, wherein the estimation of the frequency spectrum for the speech frame is sampled at a determined pitch frequency and its harmonics.

16. The apparatus of claim 13, wherein the creation of the voicing shape is accomplished using voicing likelihood values in the at least one mixed band.

17. The apparatus of claim 13, wherein at least one of the at least one voiced band, the at least one unvoiced band, and the at least one mixed band covers the entire spectrum of the plurality of frequencies.

18. The apparatus of claim 13, wherein at least one of the at least one voiced band, the at least one unvoiced band, and the at least one mixed band covers no portion of the spectrum of the plurality of frequencies.

19. An apparatus, comprising:

means for obtaining an estimation of a frequency spectrum for a speech frame;

means for assigning a voicing likelihood value for each frequency of a plurality of frequencies within the estimated frequency spectrum;

means for identifying at least one voiced by determining a width within the frequency spectrum comprising a first subset of the plurality of frequencies within the estimated frequency spectrum with voicing likelihood values above a pre-specified threshold;

means for identifying at least one unvoiced band by determining a width within the frequency spectrum comprising a second subset of the plurality of frequencies within the estimated frequency spectrum with voicing likelihood values below a pre-specified threshold;

means for identifying at least one mixed band by determining a width within the frequency spectrum comprising a third subset of the plurality of frequencies between the voiced band and the unvoiced band; and means for creating a voicing shape for the at least one mixed band of frequencies.

20. The apparatus of claim 19, wherein the at least one voiced band includes zero or more frequencies of the plurality of frequencies having voicing likelihood values within a first range of values;

the at least one unvoiced band includes zero or more frequencies of the plurality of frequencies having voicing likelihood values within a second range of values; and the at least one mixed band includes zero or more frequencies of the plurality of frequencies having voicing likelihood values between the at least one voiced band and the at least one unvoiced band.

21. A method, comprising:

reconstructing, by a processor, magnitude and phase values of a frequency spectrum based on parameters of a model associated with the frequency spectrum, the frequency spectrum having a plurality of frequencies, the frequency spectrum comprising at least one voiced band, at least one unvoiced band wherein the voiced band is identified by determining a width within the frequency spectrum comprising a first subset of the plurality of frequencies within the estimated frequency spectrum with voicing likelihood values above a pre-specified threshold, the unvoiced band is identified by determining a width within the frequency spectrum comprising a second subset of the plurality of frequencies within the estimated frequency spectrum with voicing likelihood values below a pre-specified threshold, and the mixed band is identified by determining a width within the frequency spectrum comprising a third subset of the plurality of frequencies between the voiced band and the unvoiced band, and wherein the parameters of the model include parameters associated with a voicing shape corresponding to the at least one mixed band; and converting the frequency spectrum into a time domain.

22. The method of claim 21, wherein the spectrum is converted into the time domain using a Fourier transform.

23. The method of claim 21, wherein the spectrum is converted into the time domain using sinusoidal oscillators.

24. The method of claim 21, wherein, for the reconstruction of the spectrum, the phase value for the at least one voiced band is assumed to evolve linearly.

25. The method of claim 21, wherein, for the reconstruction of the spectrum, the phase value for the at least one unvoiced band is randomized.

26. The method of claim 21, wherein, for the reconstruction of the spectrum, the magnitude and phase values for the at least one mixed band comprise a combination of the respective magnitude and phase values for voiced and unvoiced contributions.

27. The method of claim 21, wherein, for the reconstruction of the spectrum, the magnitude and phase values for the at least one mixed band each comprise two separate values.

28. The method of claim 21, wherein the at least one voiced band, the at least one unvoiced band, and the at least one mixed band each comprise a single band.

29. A computer program product, embodied in a non-transitory computer-readable medium, for synthesizing a model of a speech frame over a spectrum of frequencies, comprising computer code for performing the actions of claim 21.

30. An apparatus, comprising:

a processor, and a memory unit communicatively connected to the processor and including:

computer code for reconstructing magnitude and phase values of a frequency spectrum based on parameters of a model associated with the frequency spectrum, the frequency spectrum having a plurality of frequencies, the spectrum comprising at least one voiced band, at least one unvoiced band, and at least one mixed band, wherein the voiced band is identified by determining a width within the frequency spectrum comprising a first subset of the plurality of frequencies within the estimated frequency spectrum with voicing likelihood values above a pre-specified threshold, the unvoiced band is identified by determining a width within the frequency spectrum comprising a second subset of the plurality of frequencies within the estimated frequency spectrum with voicing likelihood values below a pre-specified threshold, and the mixed band is identified by determining a width within the frequency spectrum comprising a third subset of the plurality of frequencies between the voiced band and the unvoiced band, and wherein the parameters of the model include parameters associated with a voicing shape corresponding to the at least one mixed band; and computer code for converting the frequency spectrum into a time domain.

31. The apparatus of claim 30, wherein, for the reconstruction of the spectrum, the phase value for the at least one unvoiced band is randomized.

32. The apparatus of claim 30, wherein, for the reconstruction of the spectrum, the magnitude and phase value for the at least one mixed band comprise a combination of the respective magnitude and phase values for voiced and unvoiced contributions.

33. The apparatus of claim 30, wherein the at least one voiced band, the at least one unvoiced band, and the at least one mixed band each comprise a single band.

* * * * *

UNITED STATES PATENT AND TRADEMARK OFFICE

CERTIFICATE OF CORRECTION

PATENT NO. : 8,489,392 B2
APPLICATION NO. : 11/855108
DATED : July 16, 2013
INVENTOR(S) : Nurminen et al.

It is certified that error appears in the above-identified patent and that said Letters Patent is hereby corrected as shown below:

In the Claims:

Column 6,
Line 25, "voiced hand" should read --voiced band--.

Column 7,
Line 61, "one unvoiced band wherein the voiced band" should read
--one unvoiced band, and at least one mixed band, wherein the voiced band--.

Signed and Sealed this
Twenty-ninth Day of October, 2013

Teresa Stanek Rea
*Deputy Director of the United States Patent and Trademark Office*